United States Patent [19]

Bellinger

[11] Patent Number: 4,927,155

[45] Date of Patent: May 22, 1990

[54] BOARD GAME

[76] Inventor: Jeffrey N. Bellinger, 56 Frances Dr., Clark, N.J. 07066

[21] Appl. No.: 340,285

[22] Filed: Apr. 19, 1989

[51] Int. Cl.[5] ..... A63F 3/00

[52] U.S. Cl. ..... 273/255; 273/146; 273/288

[58] Field of Search ..... 273/253–255, 273/262

[56] References Cited

U.S. PATENT DOCUMENTS

| | | | |
|---|---|---|---|
| 1,315,483 | 9/1919 | Edwards | 273/262 |
| 4,695,056 | 9/1987 | Cornelson et al. | 273/253 |
| 4,779,875 | 10/1988 | Sypal | 273/254 |

FOREIGN PATENT DOCUMENTS

| | | | |
|---|---|---|---|
| 524065 | 7/1940 | United Kingdom | 273/262 |

*Primary Examiner*—Benjamin Layno

*Attorney, Agent, or Firm*—H. Jay Spiegel

[57] ABSTRACT

The inventive game may be played by from two to four players, each one of which has a home base game piece and a plurality of salt birds. At the beginning of the game, the home bases and a plurality of other game pieces are placed on the game board in a prescribed manner including a plurality of salt tablets. Each player has a plurality of bird game pieces for movement on the board. Each player has a plurality of discs describing various bad habits. The object of the game for each player is to obtain a predetermined number of salt tablets by moving their bird game pieces and landing on the spaces having salt tablets, then returning the obtained salt tablets to their home bases while getting rid of their bad habit discs.

5 Claims, 3 Drawing Sheets

BOARD GAME

BACKGROUND OF THE INVENTION

Board games wherein combat or conquest is the game theme are well known. However, applicant is unaware of any prior art teaching a board game even similar to the teachings of the present invention.

Applicant is aware of U.S. Pat. No. 412,297 to Rutherford, 3,860,241 to Leftin and 3,977,677 to Magiera. Each of these patents teaches the concept of a game played on a board and wherein the theme of the game includes a battle with other players to determine the winner. However, none of these patents teaches a game like that which is disclosed herein.

SUMMARY OF THE INVENTION

The present invention relates to a board game titled "The Salt Birds of Akarah". Akarah is a fictional desert on a planet far away from earth. In the fictional story which forms a basis for inventive game, due to the arid environment in which the native people of Akarah live, these native people have trained the birds of the region to endure the dangers of the desert and hunt for the rare compound, sodium chloride, which they desperately need to survive. These salt birds of Akarah form an integral part of the inventive game.

The inventive game includes the following interrelated aspects and features:

(a) In a first aspect, the inventive game is played on a board of hexagonal shape having a plurality of spaces thereon defined by dots or openings. At the beginning of the game, various game pieces are placed on the board in positions thereon defined by the rules of the game. These pieces may be placed on the board either randomly by throwing of dice which form a part of the game or by using a chart of starting positions.

(b) These pieces include a home base for each player, a plurality of salt birds per player, a multiplicity of salt tablets, a multiplicity of arctic crystals of different colors, a pair of dark crystals, a multiplicity of laser gun pieces, one magic tree, a plurality of transport gates, a pond, a multiplicity of nuclear bombs, a multiplicity of bad habit markers and a deck of playing cards, a multiplicity of bad habit discs and a multiplicity of exciting fruit challenge cards.

(c) In playing the game, only the crystals and the birds may be moved through throwing of the dice. A player may win by either destroying all opponents' salt birds using the dark crystals and laser guns, as will be described in greater detail hereinafter, or by successfully bringing a multiplicity, for example, five salt tablets back to the home base using the salt birds while also getting rid of a plurality of bad habit discs using a routine known as the "fruit challenge". Alternatively, the game may end when all playing cards have been drawn with the winner being determined by scoring based upon the number of salt tablets which have been brought to the home base, the number of salt birds the player has left as well as by determining how many bad habit discs are in the possession of the respective players.

Accordingly, it is a first object of the present invention to provide an improved board game having a battle and conquest theme.

It is a further object of the present invention to provide such a board game which is played in a fictional desert on a planet very far from our own.

It is a further object of the present invention to provide such a board game wherein players may throw dice and may move game pieces responsive to the values shown by the dice.

These and other objects, aspects and features of the present invention will be better understood from the following detailed description of the preferred embodiment when read in conjunction with the appended drawing FIGS.

SPECIFIC DESCRIPTION OF THE PREFERRED EMBODIMENT

Figure 1:
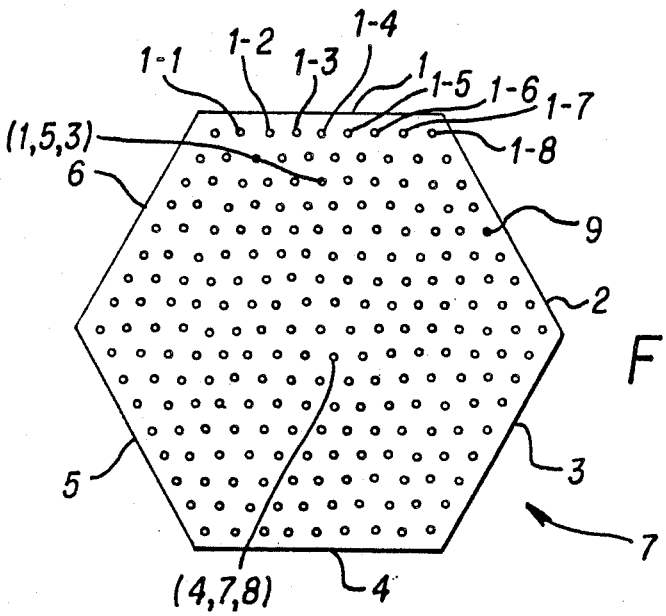
FIG. 1 shows a top view of the inventive game board.

With reference, first, to FIG. 1, it is seen that the inventive game board F is hexagonal in shape having six sides 1, 2, 3, 4, 5 and 6. A plurality of spaces 9 are identified in FIG. 1 by dots which may signify printing on the board 1 or, alternatively, holes or openings through or in, respectively, the board surface.

Figure 2:
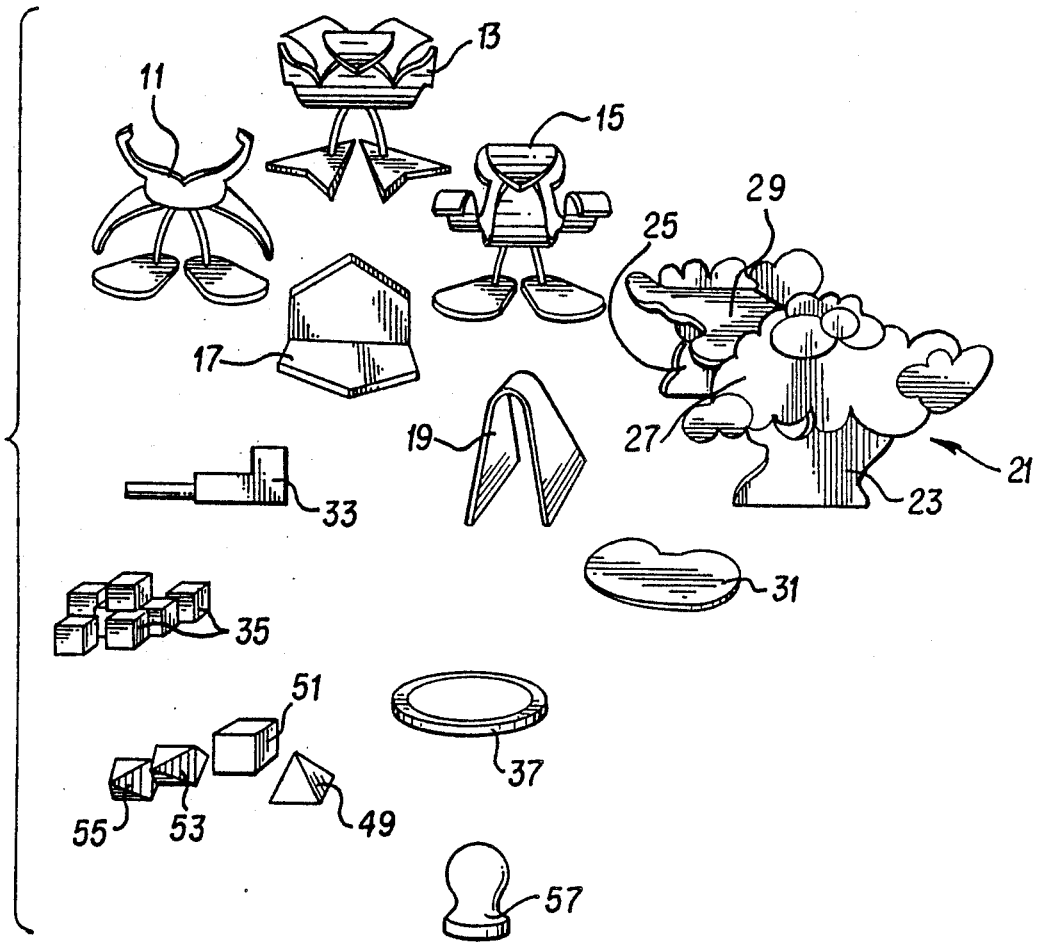
FIG. 2 shows a perspective view of the various game pieces which are used in playing the inventive game.

FIG. 2 shows examples of the playing pieces which may be used in playing the inventive game. Thus, FIG. 2 shows a plurality of different styles of birds 11, 13 and 15, a home base 17, a transport gate 19, a magic tree 21 termed "Roland's Magic Tree", including two trunks 23, 25, a leafy portion 27 and a flat elevated surface 29.

Shown in FIGS. 2, 4*a*, 4*b*, 4*c* and 4*d* are a pond 31, a laser gun 33, a multiplicity of salt tablets 35, a bad habit marker 37 (in the game, five such markers are employed), dark crystals 39, three different colors of arctic crystals 41 (red), 43 (yellow), and 45 (blue), and a set of dice generally designated by the reference numeral 47. The dice 47 consists of one four-sided die 49, one six-sided die 51 and two eight-sided dice 53 and 55. Each die has markings on each surface (not shown) from one to N, with N signifying the number of faces of a respective die. Thus, the die 49 has markings for the numerals 1–4. The dice 51 has markings for the numerals 1–6 and the dice 53 and 55 each have markings for the numerals 1–8.

Additionally, FIG. 2 shows a playing piece designed to simulate a nuclear bomb and designated by the reference numeral 57.

Figure 3:
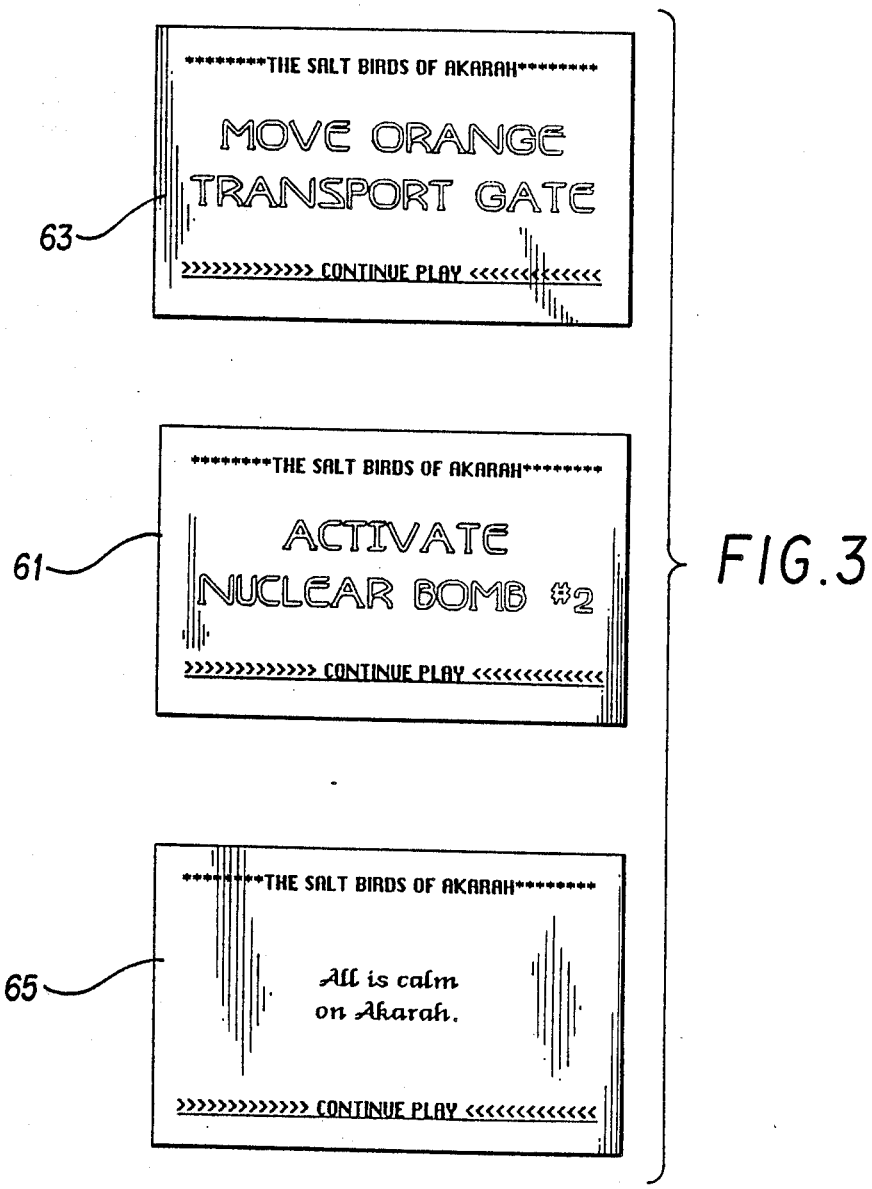
FIG. 3 shows three examples of written information on playing cards.
Figure 4A:
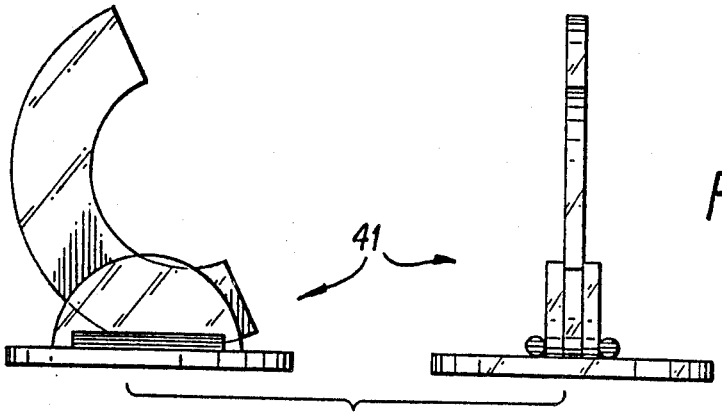
FIGS. 4*a*, 4*b*, 4*c* and 4*d* show the various crystals which are pieces used in the inventive game.
Figure 4B:
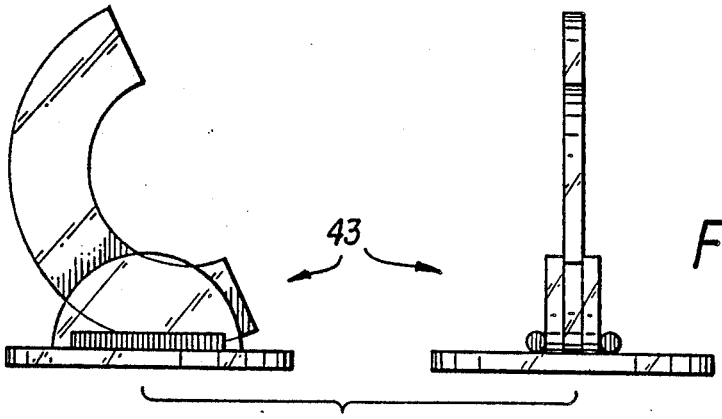
Figure 4C:
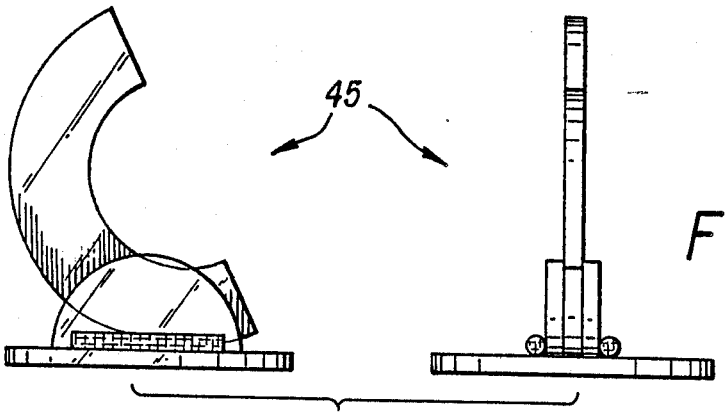
Figure 4D:
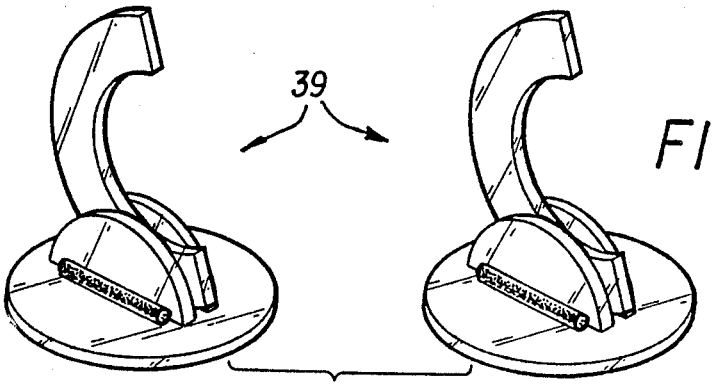

With reference to FIG. 3, three examples of cards which are included in the playing games of the present invention are illustrated. A first such playing card is designated by the reference numeral 61 and has the phrase thereon, "ACTIVATE NUCLEAR BOMB #2 CONTINUE PLAY". A second such card is designated by the reference numeral 63 and has the phrase thereon, "MOVE ORANGE TRANSPORT GATE CONTINUE PLAY". A third type of card is designated by the reference numeral 65 and has the phrase, "ALL IS CALM ON AKARAH CONTINUE PLAY". These are but examples of the cards which are included in the deck of playing cards of the present invention. In the inventive deck, there are three cards labeled "MOVE ORANGE TRANSPORT GATE", there are three cards labeled "MOVE BLUE TRANSPORT GATE", there are six "ACTIVATE NUCLEAR BOMB"cards and twelve "CONTINUE PLAY" cards, each of which has a unique humorous message printed thereon. Their significance will be described in greater detail hereinafter.

Further, the game includes 20 bad habit discs, each one of which has a so-called bad habit printed thereon. Examples of bad habits printed on these discs include "GREEDY", "OBNOXIOUS", "RECKLESS", "STRATEGICALLY SHORT-SIGHTED (STUPID)" and "UNTRUSTWORTHY".

With reference back to FIG. 2, a specific description will be made of each piece.

The Home Bases 17 are used to store the salt tablets 35 that a salt bird 11, 13 or 15 has returned with. When a salt bird that is returning with a salt tablet 35 is in a space adjacent to the home base he may simply place the salt tablet in the home base. Once a salt tablet is in the home base, it is safe and cannot be removed unless the owner wishes to do so. Placing a salt tablet into the home base may be done at any time and does not take an extra turn.

The salt birds 11, 13, 15 are used to go out into the desert and get the salt tablets 35. Salt birds pick up salt tablets or laser guns 33 by landing on the space that they are on. Salt tablets and laser guns are the only objects that a salt bird may hold and it can only pick up one of each object at any particular time. A salt bird may also put down an object by leaving it on the space that the salt bird was on before moving away during its turn.

The salt tablets 35 are what the salt birds seek and are the very essence of life on Akarah.

The arctic crystals (FIGS. 4*a*, 4*b* and 4*c*) 41, 43, 45 are used to freeze the salt birds. By surrounding a salt bird by any two arctic crystals of the same color, you can freeze that salt bird. The arctic crystals must be directly across from one another to accomplish this. The player whose salt bird is frozen cannot move the arctic crystals that are responsible for the freezing. He can, however, have another one of his salt birds blast the arctic crystals with a laser gun if he is lucky enough to have one or he can try to convince another player to move the arctic crystal for him. Once a salt bird is frozen, he cannot move, shoot or challenge.

Laser guns 33 are used primarily to destroy objects on the board. As a turn, a salt bird with a laser gun may destroy the following objects if they are in an adjacent space:

(a) Arctic crystals — to free trapped salt birds or prevent one from getting frozen.

(b) Salt tablets or laser guns — to prevent other players from getting them.

(c) Nuclear bombs — although by blasting one you will activate it which may very well destroy your salt bird.

(d) The pond — if it is in your way and you want to get wet.

(e) Other salt birds — unlike all of the other objects, in this case the destroying of your opponents salt bird is not guaranteed. When attempting to blast a salt bird, roll any of the game dice and choose odds or evens. If you choose correctly, your opponent's salt bird is destroyed along with anything that it may have been carrying at the time. If you choose incorrectly, your opponent's salt bird not only survives the blast attempt but it also gets your laser gun. In this manner, a salt bird may have more than one laser gun.

Things that cannot be destroyed by a laser gun are: home bases, dark crystals, Roland's Magic Tree, transport gates and bad habit markers.

By surrounding an opponent's salt bird with the dark crystals 39 (FIG. 4*d*), you destroy it. Again, one needs both dark crystals to destroy a salt bird.

Roland's Magic Tree is a place of safety that the salt birds may flee to in times of peril. Nothing may travel in the spaces below Roland's Magic Tree and nothing that is evil may land on Roland's Magic Tree. Therefore, the only objects that are allowed on Roland's Magic Tree are: Unarmed salt birds, and salt tablets. To land on Roland's Magic Tree, simply move onto the next space along the board and up onto Roland's Magic Tree surface 29. When a salt bird is on Roland's Magic Tree, it cannot be destroyed by nuclear bombs or laser gun blasts.

Transport Gates 19 are used as a short cut for the salt birds. Two Transport Gates 19 are preferably included in the game. If a salt bird travels into either side of a Transport Gate, it may go out of either side of the other Transport Gate. Treat the center space of the Transport Gates as if they were the same space. The following rules apply to Transport Gates:

(a) Both center spaces of the Transport Gates cannot be occupied at the same time.

(b) If a piece is on the center space of the Transport Gate when it moves, the piece also moves.

(c) Since Transport Gates are indestructible, a piece on the center space of the Transport Gate is protected from nuclear bomb explosions but is not protected from laser gun fire.

(d) If a salt bird, arctic crystal or dark crystal stops on the center space of a Transport Gate it may leave from either side of either Transport Gate on the following turn.

(e) To freeze a salt bird standing on the center space of a Transport Gate, surround the center space of either Transport Gate with two arctic crystals of the same color. Destroying a salt bird with the dark crystals works the same way.

The pond 31 has no useful function in the game except to be used as an obstacle and to provide mild entertainment.

The playing cards consist of, in the preferred embodiment, 12 CONTINUE PLAY cards, 6 MOVE TRANSPORT GATE cards and 6 ACTIVATE NUCLEAR BOMB cards. The playing cards are shuffled at the game's start and one is drawn at the end of every round of play. If a CONTINUE PLAY card is drawn, nothing happens. If a MOVE TRANSPORT GATE card is drawn, then the appropriate Transport Gate is repositioned randomly by rolling the three dice as will be explained hereinafter. If the space is already occupied, then continue rolling until a space is found that is empty. If an ACTIVATE NUCLEAR BOMB card is drawn, then activate the appropriate nuclear bomb.

Nuclear bombs 57 are activated in the following manner. When an ACTIVATE NUCLEAR BOMB card is drawn, the nuclear bomb is first located (they are all numbered) and the die 49 is rolled. Numbers one, two or three correspond to the number of spaces around the nuclear bomb in which everything is destroyed. A roll of four means that the nuclear bomb is a dud and nothing happens.

Things that can be destroyed by a nuclear bomb are: salt birds, salt tablets, laser guns, arctic crystals, the pond and other nuclear bombs. Things that cannot be destroyed by nuclear bombs are: homes bases, dark crystals, Roland's Magic Tree, transport gates and bad habit markers. If other nuclear bombs are within range of an exploding nuclear bomb, they are activated and their range is determined the same way as mentioned before by rolling the die 49.

A player must improve the social graces of his village by getting rid of all of his bad habit discs as one way to help win the game. At the game's start, each player has 5 bad habit discs: (Greedy, Obnoxious, Reckless, Strategically Short-Sighted (Stupid), and Untrustworthy). A player gets rid of these bad habit discs by partaking in the exciting fruit challenge with the other players. The exciting fruit challenge is a tradition on Akarah which helps players to build character by outguessing their opponent's choosing strategy. This character building experience helps a player get over some of his bad habits. For example, to get rid of your village's Greedy disc, you must first land one of your salt birds on the space where the Greedy bad habit marker has been placed. The salt bird and the bad habit marker now share that board space. If a salt bird is already there, you can simply land next to the marker. You then declare the exciting fruit challenge and announce your opponent. Included in the game are, for example, 5 different exciting fruit challenge cards; a banana, a Granny Smith apple, a Jersey peach, a kiwi and a mango. The challenger chooses one of the fruits unseen by the opponent, and shows it to the other players. The opponent must guess which of the fruits the challenger has chosen. By rolling one of the dice 53, 55, the challenger determines the conditions for the challenge as follows:

1 – The opponent automatically wins.

2 – The challenger must choose the hidden fruit from any 2 challenge cards. The opponent gets one guess.

3 – The challenger must choose the hidden fruit from any 3 challenge cards. The opponent gets one guess.

4 – The challenger must choose the hidden fruit from any 4 challenge cards. The opponent gets one guess.

5 – The challenger must choose the hidden fruit from any 5 challenge cards. The opponent gets one guess.

6 – The challenger automatically wins.

7 – The challenger must choose the hidden fruit from any 3 challenge cards. The opponent gets two guesses.

8 – The challenger must choose the hidden fruit from any 4 challenge cards. The opponent gets three guesses.

If the challenger wins, he gets rid of the bad habit disc that corresponds to the bad habit marker he had landed on. If the opponent wins, he gets rid of the bad habit disc of his choice. An additional roll of the die 53 or 55 determines where the bad habit disc goes. If an even number is rolled, then the bad habit disc is removed from the game. If an odd number is rolled, then the bad habit disc goes to the loser of the challenge. If a player has two or more of the same bad habit discs, he must get rid of them one at a time.

The opponent is always aware of which exciting fruit challenge cards he has to choose from. Once a player has gotten rid of all of his bad habit discs, he cannot be challenged again.

To play the game, all of the pieces are placed on the board randomly using the following procedure. The advantage of randomly placing the pieces on the board is that every game will be different. To place the pieces randomly, roll the die 51 and both eight-faced dice 53, 55. You now have three coordinates. Plot them referring to FIG. 1. The first number tells you what side of the board you are on e.g. a first number of 5 would require a player to start on the first coordinate on the side labelled 5 in FIG. 1, 5—1. The second number tells you how many spaces along that side to travel before counting diagonally in a direction so as to form an acute angle with respect to the board side started from the number of spaces on the third die. For example, 4—7—8 and 1—5—3 are shown.

Alternatively, players may take turns placing the pieces on the board until everything is down. The pieces that are placed on the board at the start of the game are always in this order:

Roland's Magic Tree (which takes up 9 spaces);

The Pond (which takes up 3 spaces);

The Transport Gates (which take up 3 spaces each).

Although these pieces occupy more than one space, the roll of the dice will give you an idea of where it should go. All one has to do is line up the spaces on the board with those covered by the piece. The actual direction of the piece is left up to the individual. Since, at this time no players have pieces on the board, there can be no advantage to any particular position and therefore the direction of the piece does not matter.

The next pieces placed down are the home bases. Once this is done, each player places his salt birds on any vacant spaces next to his home base. If three vacant spaces are not available, a player must place his salt birds as close to the home base as possible.

Finally, place the following pieces on the board in whatever order is desired; 24 salt tablets, 12 arctic crystals, 3 laser guns, 2 dark crystals, 6 nuclear bombs and 5 bad habit markers.

No two pieces may occupy the same space at the same time, with the following exception: salt tablets may land on Roland's Magic Tree, if the roll of the dice so indicates.

The owner of the game may, if desired, start play and it continues clockwise. First, the die 49 is rolled. This tells a player how many moves he is allowed in his turn. A roll of one, two or three corresponds, respectively, to 1, 2 or 3 moves. A roll of four is a 'Lose-A-Turn'. The die 51 is rolled to see how far an object may go on a move. The only objects a player may move are his salt birds or any crystals. A player may only move an object once during his turn, even if he has rolled for more than one move during that turn. At the end of every round, a playing card is picked and the instructions are carried out.

To summarize, every round of play has one turn for each player. Each turn can have up to three moves.

The game is over when a player has no bad habits left and has 5 salt tablets in his home base.

An alternate way to win is to simply destroy all of the other salt birds.

The last way that the game can end is if all of the playing cards have been drawn. After the instructions are followed, the players add up their scores as follows:

Each salt bird still alive (+1) point

Each salt tablet in your home base (+1) point

Each bad habit disc you still have (−1) point

The player with the highest score wins the game.

Games with fewer than 4 players - If there are only three players in the game, then only place 18 salt tablets on the board at the game's start. If there are only two players in the game, then only place 12 salt tablets on the board at the game's start.

The Special Pond Rule - This rule concerns the person who chooses the playing cards at the end of every round. If he activates a nuclear bomb which in turn blows up the pond, he is immediately showered with any and all liquids (drinks) that might be at hand at the time. This rule is for amusement purposes only and has no bearing on the outcome of the game.

Accordingly, a game has been described in terms of a preferred embodiment thereof which fulfills each and every one of the objects of the game as set forth hereinabove and provides a new, interesting and challenging board game. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A board game comprising:

(a) a board having a multiplicity of spaces formed over the entirety of a surface thereof;

(b) a plurality of game pieces placeable on said board in random fashion, said pieces including:

(i) a plurality of birds for each player, each said bird for moving about said board;

(ii) a tree for providing a place of safety for a said bird;

(iii) a home base for each player, each home base being randomly placeable on said board and being provided for storing select game pieces;

(iv) a plurality of weapons for destroying select game pieces;

(v) a plurality of tablets adapted to be collected by a said player;

(vi) a plurality of markers, each marker for placement on a space on said board;

(vii) a pair of transport gates to permit rapid movement across said board;

(viii) a plurality of crystals for freezing a said bird of an opponent;

(c) a chance device used to determine player moves;

(d) players being permitted to move their birds and any crystals responsive to operation of said chance device, the object of said game being to obtain a predetermined number of tablets, using said birds to bring said tablets back to a respective said home base.

2. The invention of claim 1, wherein said tablets comprise salt tablets.

3. The invention of claim 1, wherein said markers comprise one marker for each of five bad habits, each player possessing discs corresponding to said bad habits, and when a bird lands on a said marker, the corresponding player may challenge an opponent to a contest, the winner of which gets rid of a said corresponding disc, a further object of said game being to get rid of all bad habit discs.

4. The invention of claim 1, wherein said chance device comprises a plurality of dice of diverse geometric shapes.

5. The invention of claim 1, wherein said pieces include at least one bomb on said board which may be exploded to destroy adjacent pieces.

* * * * *